US007070039B2

(12) United States Patent
Dombek

(10) Patent No.: US 7,070,039 B2
(45) Date of Patent: Jul. 4, 2006

(54) APPARATUS AND METHOD FOR THE TRANSFER OF ROD-SHAPED ARTICLES

(75) Inventor: Manfred Dombek, Dassendorf (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/940,930

(22) Filed: Sep. 15, 2004

(65) Prior Publication Data

US 2005/0077148 A1 Apr. 14, 2005

(30) Foreign Application Priority Data

Sep. 16, 2003 (EP) ..... 03090298

(51) Int. Cl.
*B65G 47/26* (2006.01)

(52) U.S. Cl. ..... 198/432; 198/430; 198/450

(58) Field of Classification Search ..... 198/430, 198/471.1, 377.08, 475.1, 478.1, 432, 450, 198/457.01
See application file for complete search history.

(56) References Cited

U.S. PATENT DOCUMENTS

| | | | | |
|---|---|---|---|---|
| 4,406,197 A | | 9/1983 | Bardenhagen et al. | |
| 4,645,063 A | * | 2/1987 | Seragnoli | 198/450 |
| 4,804,079 A | * | 2/1989 | Hensgen et al. | 198/450 |
| 4,827,948 A | * | 5/1989 | Schumacher | 131/282 |
| 5,033,482 A | | 7/1991 | Belvederi et al. | |
| 5,255,777 A | | 10/1993 | Pawelko | |
| 5,267,577 A | | 12/1993 | Rizzoli et al. | |
| 5,908,030 A | | 6/1999 | Coi et al. | |
| 5,921,375 A | * | 7/1999 | van Laar | 198/471.1 |
| 6,105,750 A | * | 8/2000 | Belvederi | 198/432 |

FOREIGN PATENT DOCUMENTS

| | | |
|---|---|---|
| DE | 4103017 | 8/1991 |
| DE | 4129672 | 3/1993 |
| DE | 4039134 | 1/2001 |
| EP | 0838163 | 4/1998 |
| EP | 0895722 | 11/2002 |
| GB | 2238705 | 6/1991 |

* cited by examiner

*Primary Examiner*—James R. Bidwell
(74) *Attorney, Agent, or Firm*—Greenblum & Bernstein, P.L.C.

(57) ABSTRACT

An apparatus for the transfer of rod-shaped articles from a longitudinal conveyor that longitudinal axially conveys the articles onto a transverse conveyor that transverse axial conveys the articles transversely to their axes, a direction of transport of the longitudinal conveyor and the transverse conveyor being transverse to each other. The apparatus includes a conveyor having receptacles structured to receive articles from the longitudinal conveyor and to discharge the received articles onto the transverse conveyor. Moreover, the conveyor is structured and arranged to receive at least two pairs of articles, which are delivered to the conveyor on separate tracks of the longitudinal conveyor. Additionally, the conveyor is further structured and arranged to discharge the pairs of articles to two separate tracks of the transverse conveyor. The instant abstract is neither intended to define the invention disclosed in this specification nor intended to limit the scope of the invention in any way.

25 Claims, 5 Drawing Sheets

APPARATUS AND METHOD FOR THE TRANSFER OF ROD-SHAPED ARTICLES

CROSS-REFERENCE TO RELATED APPLICATIONS

The present application claims priority under 35 U.S.C. § 119 of European Patent Application No. 03 09 0298.5, filed on Sep. 16, 2003, the disclosure of which is expressly incorporated by reference herein in its entirety.

BACKGROUND OF THE INVENTION

1. Field of the Invention

The invention concerns an apparatus for the transfer of rod-shaped articles, in particular cigarettes, from a longitudinal conveyor for longitudinal axial conveying of the articles onto a transverse conveyor for transverse axial conveying of the articles. The directions of transport of the longitudinal conveyor and transverse conveyor run transversely to each other. Further, a conveyor with receptacles is provided for receiving several articles from the longitudinal conveyor and for discharging the received articles onto the transverse conveyor. Furthermore, the invention concerns a method for the transfer of rod-shaped articles, in particular cigarettes, from a longitudinal conveyor for longitudinal axial conveying of the articles onto a transverse conveyor for transverse axial conveying of the articles, in which the directions of transport of the longitudinal conveyor and transverse conveyor run transversely to each other. The method includes receiving several rod-shaped articles from the longitudinal conveyor through the use of a conveyor, rotating the conveyor to move the articles through a predetermined angle, and discharging the articles onto the transverse conveyor.

2. Discussion of Background Information

Apparatuses and methods of this kind are used in particular in the tobacco-processing industry. In a continuous cigarette rod-making machine, continuous rods of tobacco are made and usually divided into single or double-length tobacco sticks. The tobacco sticks are conveyed in their longitudinal direction and must be transferred for further processing, e.g., for attaching a filter in a filter-attaching machine. For this purpose the tobacco sticks must usually be transferred from their longitudinal axial transport direction to a transverse axial transport direction, wherein the transport directions run transversely to each other.

There are numerous apparatuses for transfer of the rod-shaped articles from a longitudinal conveyor onto a transverse conveyor. Known apparatuses have a conveyor which receives several articles or tobacco sticks arranged adjacent to each other from the longitudinal conveyor, and discharges them onto the transverse conveyor. All the known apparatuses of this kind are, however, exclusively suitable for transferring tobacco sticks arranged uniformly adjacent to each other. The tobacco sticks are for this purpose separated from continuous rods delivered uniformly adjacent to each other from a continuous cigarette rod-making machine, and guided to the transfer apparatus for further processing. However, making the continuous rods in pairs in the continuous cigarette rod-making machine has proved to be particularly advantageous. Up to now, however, only a continuous cigarette rod-making machine for making a single double rod has been known, so that the apparatuses for transfer have been designed only for the transfer of a single pair of articles. There are, however, endeavors to make continuous cigarette rod-making machines which are suitable for producing at least two double rods simultaneously.

SUMMARY OF THE INVENTION

It is therefore an aspect of the invention to provide an apparatus which is of simple construction and compact for the transfer of rod-shaped articles with an increased productivity. Furthermore, it is the aspect of the invention to propose a method which ensures easy and cost-efficient transfer yet which is more productive than known methods.

This aspect is achieved by an apparatus with the characteristics mentioned hereinbefore, in which the conveyor is designed for receiving at least two pairs of articles that are each composed of two articles, each pair of articles is delivered on a separate track of the longitudinal conveyor, and the pairs of articles are discharged to two separate tracks of the transverse conveyor. With this design according to the invention, a doubling of output is ensured, so that in particular a combination with a continuous cigarette rod-making machine for the manufacture of two times two continuous rods, which are each conveyed as a double rod, is also possible.

Advantageously, the conveyor includes two separate drums which are designed for receiving one pair of articles each from one of the tracks of the longitudinal conveyor and for discharging one pair of articles each onto one of the tracks of the transverse conveyor. As a result, a particularly cost-efficient and flexible option for transferring more than one pair of articles is provided. Which, standard parts can be used, which lowers the manufacturing costs of such apparatuses, independent reception of the articles from each track of the longitudinal conveyor and discharge of the articles onto the transverse conveyor are possible, whereby e.g. different varieties of tobacco can be processed on one apparatus.

In one development, the two drums are arranged one behind the other in the direction of transport of the longitudinal conveyor, so that discharge to two parallel tracks of the transverse conveyor is possible in a particularly simple manner.

In a further embodiment, the longitudinal conveyor in the region of the two tracks which run parallel to each other and which each serve to convey a continuous double rod is assigned in each case a separator for separating the articles from the double rods in pairs. This makes it easier to remove the articles from the longitudinal conveyor in pairs.

A further embodiment is provides a transverse conveyor that includes two separate transfer drums forming the tracks. Each transfer drum is functionally connected to one of the drums. With this arrangement, flexible and compact transfer is ensured.

In a particular embodiment, one of the drums of the conveyor is arranged below the track and the other drum is arranged above the track, and the distance A between the two separators in the direction of transport of the longitudinal conveyor is equal to the distance B between the two center axes of the drums in the direction of transport of the longitudinal conveyor and equal to the distance C between the two transfer drums transverse to the direction of transport of the transverse conveyor. Thus, a particularly space-saving arrangement can be provided.

Further, an aspect of the above-mentioned invention is directed to a method that also includes at least two pairs of articles, in which each pair is composed of two articles. Each pair of articles is delivered on a separate track of the longitudinal conveyor, are discharged to two separate tracks of the transverse conveyor. By this method, a simple and cost-efficient process with a high productivity is proposed.

One aspect of the present invention includes an apparatus for the transfer of rod-shaped articles from a longitudinal conveyor that longitudinal axially conveys the articles onto a transverse conveyor that transverse axially conveys the articles transversely to their axes, a direction of transport of the longitudinal conveyor and the transverse conveyor being transverse to each other. The apparatus includes a conveyor having receptacles structured to receive articles from the longitudinal conveyor and to discharge the received articles onto the transverse conveyor. Moreover, the conveyor is structured and arranged to receive at least two pairs of articles, which are delivered to the conveyor on separate tracks of the longitudinal conveyor. Additionally, the conveyor is further structured and arranged to discharge the pairs of articles to two separate tracks of the transverse conveyor.

In a further aspect of the invention, the rod-shaped articles can be cigarettes. Moreover, the conveyor can be structured and arranged to simultaneously receive and discharge a plurality of pairs of articles. Additionally, the conveyor can include two separate drums which are each structured and arranged to receive one pair of articles from a respective separate track of the longitudinal conveyor and to discharge one pair of articles onto a respective separate track of the transverse conveyor. Moreover, the two drums can be arranged one behind the other in the direction of transport of the longitudinal conveyor. Additionally, the drums can be configured to be driven in one of opposite or the same direction. Moreover, both drums can be arranged above the longitudinal conveyor. Furthermore, one of the drums can be arranged below and the other drum can be arranged above one of the tracks. Additionally, the longitudinal conveyor can further include separators that separate the articles from double rods in pairs, the separators being positioned in a region of the separate tracks which run parallel to each other and each convey a continuous double rod. Moreover, the transverse conveyor can include two separate transfer drums forming the separate tracks, each transfer drum can be associated with one of the two separate drums. Additionally, the two transfer drums can be driven optionally in opposite or the same directions. Moreover, a distance A between separators in the direction of transport of the longitudinal conveyor can be equal to the distance B between two center axes of the drums in the direction of transport of the longitudinal conveyor and can be equal to the distance C between the two central axes of movement of the transfer drums transverse to the direction of transport of the transverse conveyor. Furthermore, the distances A and B can be the same and the distance C can be smaller than the distances A and B.

Another aspect of the invention includes a method for the transfer of rod-shaped articles from a longitudinal conveyor that longitudinal axially conveys the articles to a transverse conveyor that transverse axially conveys the articles, a direction of transport of the longitudinal conveyor and transverse conveyor being transverse to each other. The method includes receiving at least two pairs of rod-shaped articles from separate tracks of the longitudinal conveyor. The method further includes moving at least two pairs of the articles through predetermined angles, and discharging the at least two pairs of articles onto separate tracks of a transverse conveyor.

In a further aspect of the invention, the rod-shaped articles can be cigarettes. Moreover, a plurality of pairs of articles can be received simultaneously from the separate tracks and discharged simultaneously onto the separate tracks. Additionally, a conveyor can be structured and arranged to move the at least two pairs of articles through the predetermined angles. Furthermore, the conveyor can include at least two spider drums, such that each of the two pairs of articles are received by a respective separate drum of the conveyor and discharged to a respective separate transfer drum of the transverse conveyor. Moreover, a conveyor for transfer of rod-shaped articles can be used with the above-noted method.

Yet another aspect of the invention includes an apparatus for the transfer of rod-shaped articles that includes a longitudinal conveyor composed of at least two separate tracks that longitudinal axially convey the articles. The apparatus further includes a transverse conveyor that conveys the articles transversely to a direction of the longitudinal conveyor, and a conveyor having receptacles that receive articles from the separate tracks of the longitudinal conveyor and that discharge the received articles onto the separate tracks of the transverse conveyor.

In a further aspect of the invention, separate tracks of the longitudinal conveyor can be each structured and arranged to convey pairs of articles, and the separate tracks of the transverse conveyor are each structured and arranged to convey the pairs of articles. Moreover, the rod-shaped articles can be cigarettes. Additionally, the conveyor can be structured and arranged to simultaneously receive and discharge a plurality of pairs of articles. Furthermore, the conveyor can further include two separate drums which are structured and arranged to receive one pair of articles each from the separate tracks of the longitudinal conveyor and structured and arranged to discharge one pair of articles each onto one of the two separate tracks of the transverse conveyor.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The shown apparatuses and the method are used for the transfer of two times two articles, in particular two times two double-length tobacco sticks from a continuous cigarette rod-making machine to a filter-attaching machine.

Figure 1:
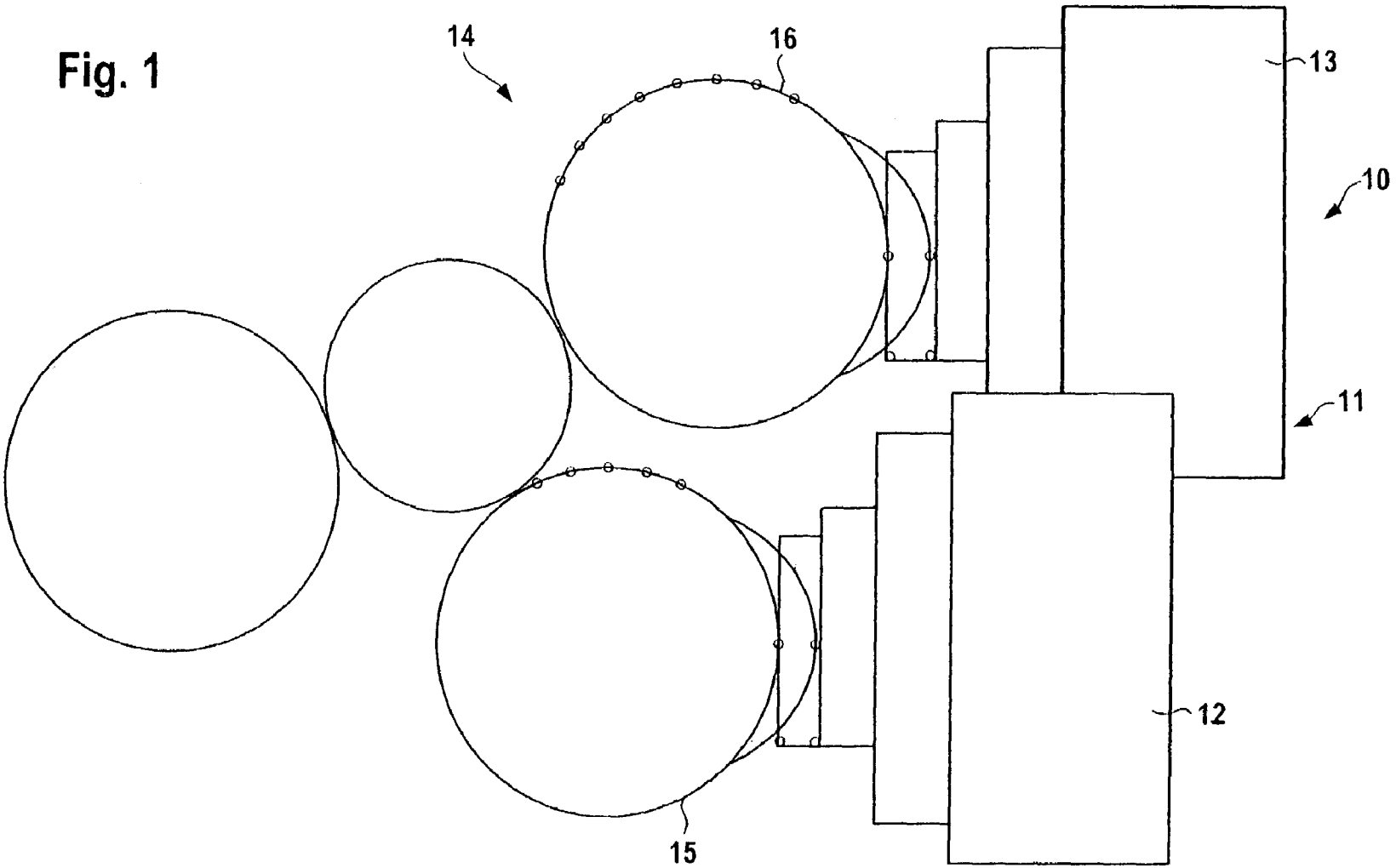
FIG. 1 shows a schematic side view of the apparatus in the direction of transport of the longitudinally axially guided articles with drums offset in height and laterally.

FIG. 1 shows the basic principle of the invention. The apparatus 10 includes a conveyor 11 which is composed of two separate drums 12 and 13. The drums 12, 13, which are also referred to as "spiders" which each work according to the principle of DE 412 96 72 C2. In the conventional manner, these spiders have several receptacles (not shown) that are in each case designed for simultaneously receiving two articles, e.g., single-length or double-length cigarettes, which are delivered parallel to each other in the longitudinal axial direction on a track. The receptacles are attached to arms, also not shown, and movable in the conventional manner in such a way that the receptacles, which are connected, e.g., to a vacuum for holding the articles, at least during transport from reception to discharge are held parallel to a horizontal plane in which the articles are also conveyed. The disclosure of DE 412 96 72 C2 is expressly incorporated by reference herein in its entirety. Likewise, U.S. Pat. No. 5,255,777 issued Oct. 26, 1993, a patent family member of DE 412 96 72 C2, is also incorporated by reference herein in its entirety.

Behind the drums 12, 13 in the direction of transport is arranged a transverse conveyor 14 (the direction of transport of the longitudinal conveyor runs transversely to the direction of transport of the transverse conveyor) which includes two transfer drums 15, 16 which form the tracks 37, 38 for carrying away the articles. Each transfer drum 15, 16 is functionally connected to a drum 12, 13 and in the conventional manner has receptacles for receiving the articles. The receptacles are arranged at the circumference of each transfer drum 15, 16 so as to be fixed and movable on a pivot lever alternately, one fixed and one movable receptacle forming in each case a unit for receiving a pair of articles. The apparatus 10 according to the invention generally speaking has two receivers, namely, the drums 12, 13, for receiving the articles from the longitudinal conveyor, and two receivers, namely, the transfer drums 15, 16, for receiving the articles from the drums 12, 13.

Figure 2:
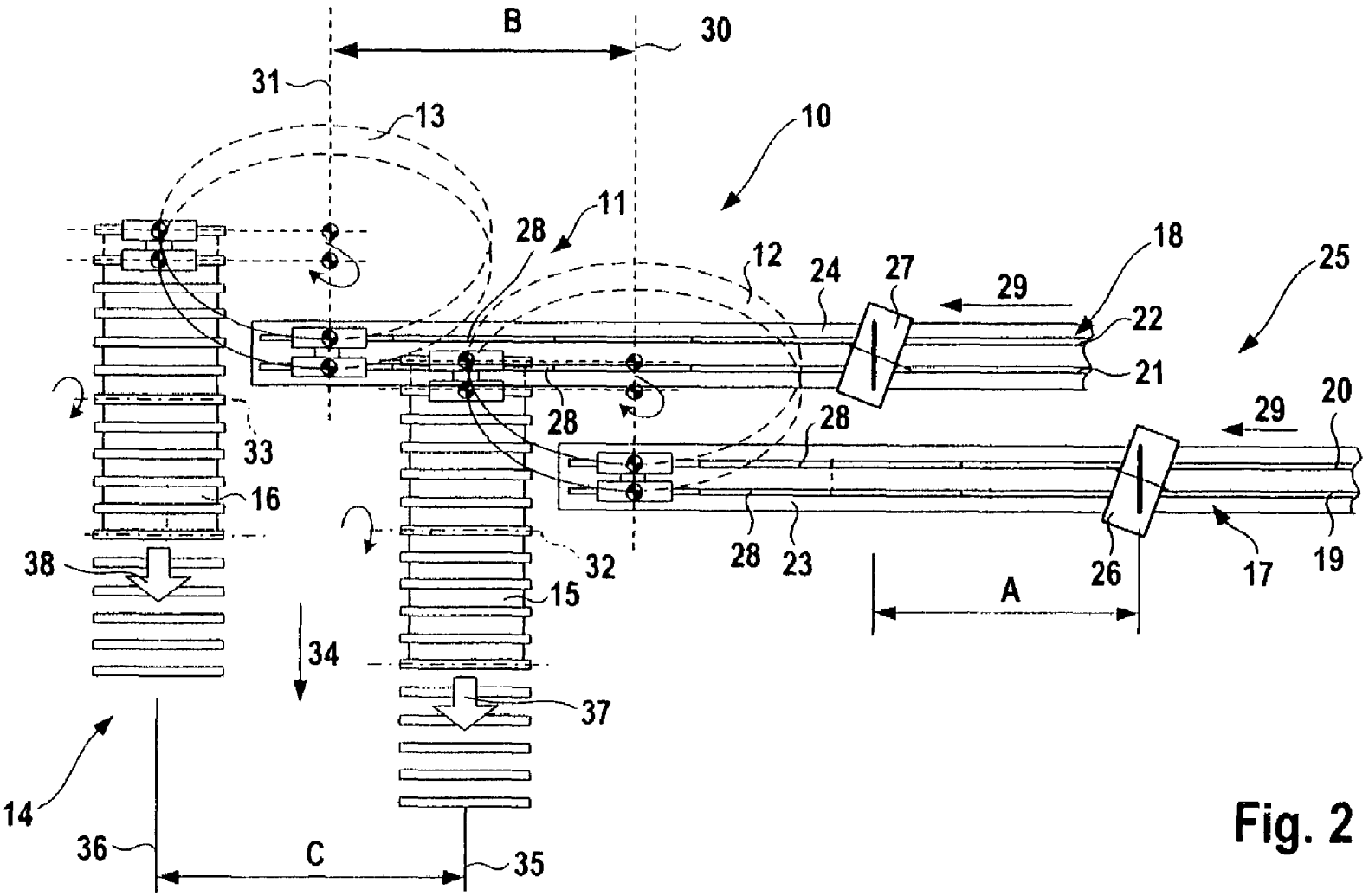
FIG. 2 shows a schematic view of a first embodiment of the apparatus.

FIG. 2 shows an embodiment of the apparatus 10 in which the conveyor 11 is supplied with two continuous double rods 17, 18 which are each composed of two continuous single rods 19, 20; 21, 22. Each continuous double rod 17, 18 is guided on a separate track 23, 24, wherein the tracks 23, 24 can be arranged in one plane or on different planes. The tracks 23, 24 form the longitudinal conveyor 25 and run parallel to each other and each have a separator 26, 27 for separating single or multiple-length tobacco sticks 28 from the continuous rods 19 to 22. Each separator 26, 27 serves to separate two tobacco sticks 28 on a track 23 or 24 simultaneously. Behind the separator 26, 27 in the direction of transport 29 of the tracks 23, 24, each track 23, 24 is assigned one of the drums 12, 13, whereby both drums 12, 13 being arranged above the tracks 23, 24.

The track 23 is offset from the track 24 in the direction of transport 29 in such a way that the drums 12, 13 are also arranged one behind the other in the direction of transport 29, wherein the distance A between the separator 26, 27 corresponds to the distance B between the center axes 30 and 31 of the drums 12, 13. The drums 12, 13 are driven in the same direction. Transversely to the tracks 23, 24 of the longitudinal conveyor 25 are arranged the transfer drums 15, 16 of the transverse conveyor 14 for transverse axial discharge of the tobacco sticks 28. The angle of transport or angle of rotation of the drums 12, 13 between reception of the tobacco sticks 28 from the longitudinal conveyor 25 and discharge of the tobacco sticks 28 onto the transverse conveyor 14 is 90° for both drums 12, 13. The transfer drums 15, 16 are arranged adjacent to each other such that the center axes 32, 33 of the transfer drums 15, 16 run parallel but offset from each other in the direction of transport 34 of the transfer drums 15, 16. The transfer drums 15, 16 run in the same direction in this embodiment. The distance C between the two transfer drums 15, 16, namely, the distance between the central axes of movement 35, 36, corresponds to the distances A and B. With this arrangement, a particularly compact design of the conveyor 11 itself is ensured. The transfer drums 15, 16 are arranged in each case behind the corresponding operatively connected drums 12, 13 in the direction of transport 29 of the tracks 23, 24.

Figure 3:
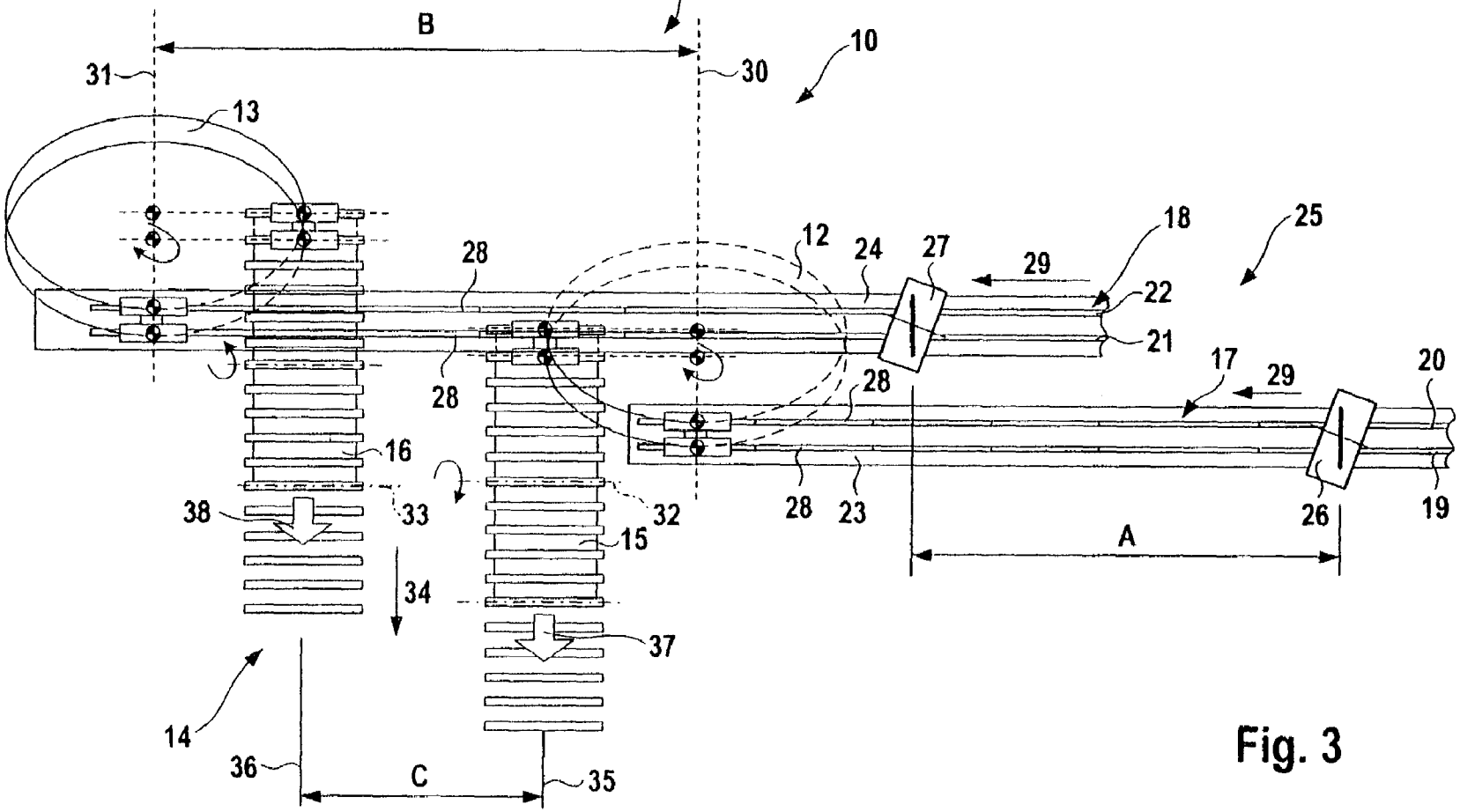
FIG. 3 shows a schematic view of a further embodiment of the apparatus.

The embodiment according to FIG. 3 is designed similarly to the embodiment shown in FIG. 2, so that the same reference numerals are used for identical parts. However, the transfer drums 15, 16 are driven in opposite directions, while the drums 12, 13 are driven in the same direction. The angles of rotation of the drums 12, 13 are different, namely, for the drum 12 is provided an angle of rotation of 90° between reception and discharge, while the angle of rotation between reception and discharge of the drum 13 is 270°. The two transfer drums 15, 16 are located between the drums 12, 13, so that the distance C between the transfer drums 15, 16 is smaller than the distances A and B, which correspond to each other. Due to this arrangement, a particularly compact design of the apparatus following the conveyor 11, e.g. the filter-attaching machine, is ensured. However, the distances A, B and C in the embodiment of FIG. 3 vary according to size from the distances A, B and C in the embodiment of FIG. 2.

Figure 4:
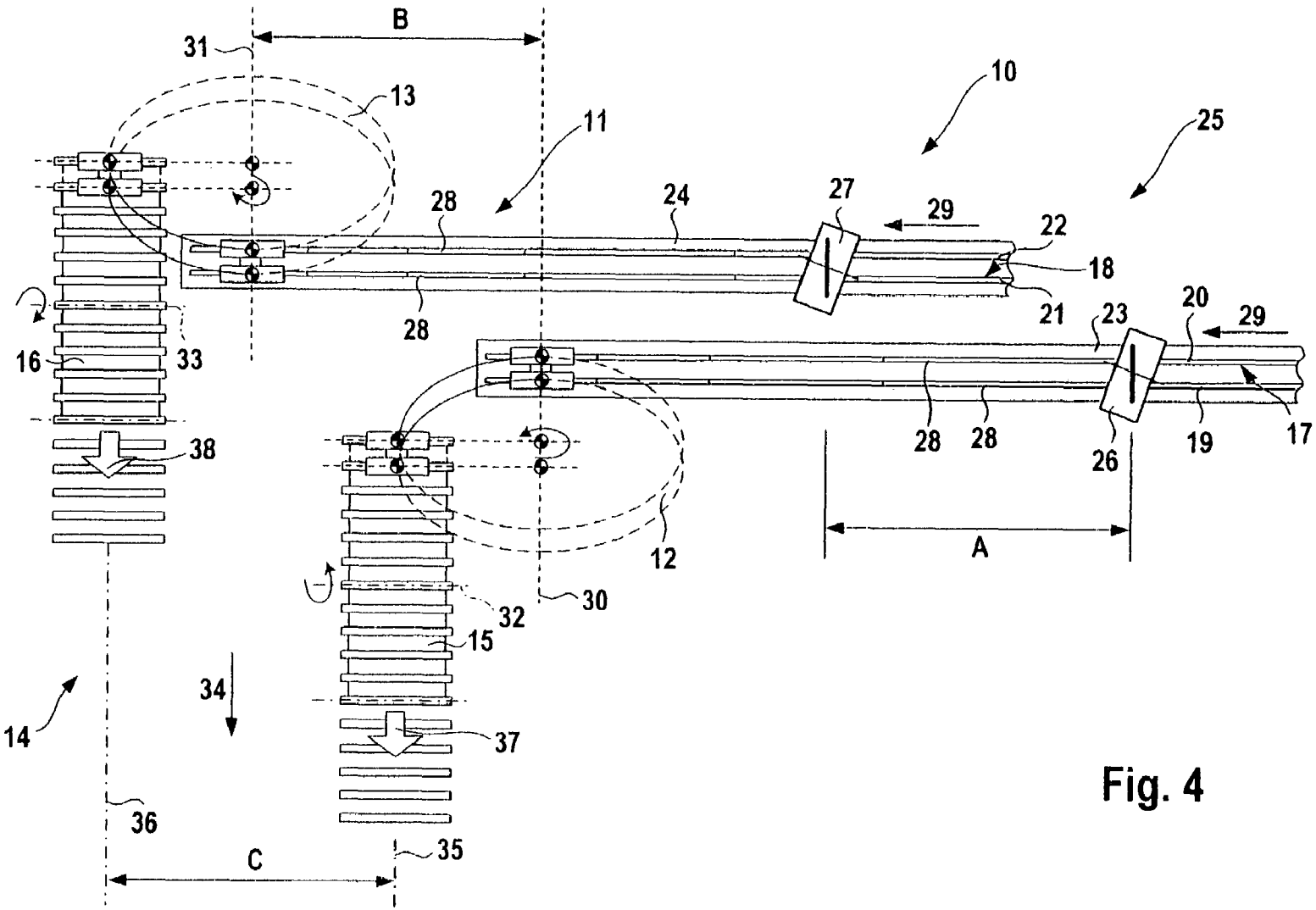
FIG. 4 shows a schematic view of a further embodiment of the apparatus.

A further embodiment can be seen in FIG. 4. Again the same reference numerals are used for identical parts. The apparatus 10 described in this figure differs from the apparatus 10 described above in that both the drums 12, 13 and the transfer drums 15, 16 are driven in opposite directions. Furthermore, the drum 12 is arranged below the track 23, while the drum 13 is arranged above the track 24. The angle of rotation for both drums 12, 13 from reception to discharge of the tobacco sticks 28 is 90°. As in the embodiment in FIG. 2, the transfer drums 15, 16 are, in turn, arranged behind the drums 12, 13 respectively in the direction of transport 29, so that with respect to the distances A, B and C the state which has already been described for FIG. 2 arises. Also the size of the distances A, B, C corresponds to those of FIG. 2.

In the embodiment according to FIG. 5, in turn, the drum 12 is arranged below the track 23 and the drum 13 is arranged above the track 24. However, the transfer drums 15, 16 of the transverse conveyor 14 are both arranged between the drums 12, 13, so that the state is repeated with respect to the distances (A=B, A, B>C) according to FIG. 3, which also applies to the size of the distances. In this embodiment, however, the drums 12, 13 are driven in opposite directions, while the transfer drums 15, 16 are driven in the same direction. The angle of rotation of the drum 12 is 90°. The angle of rotation of the drum 13 is 270°.

Below, the method is described with the aid of the individual embodiments.

In the method with the apparatus 10 in FIG. 2, two continuous double rods 17, 18 of tobacco or the like are guided with the longitudinal conveyor 25 longitudinally axially to the conveyor 11. Each continuous double rod 17, 18 is guided on a separate track 23, 24. From the continuous double rods 17, 18, tobacco sticks 28 are separated from the continuous rods 19, 20 or 21, 22 through the use the separators 26, 27. As the tracks 23, 24 are offset from each other in the direction of transport 29, separation of the tobacco sticks 28 also takes place with staggering in place and hence time. The continuous double rod 17 on the track 23 is separated in place and time before the continuous double rod 18 on the track 24. The tobacco sticks 28 are then delivered in pairs to one drum 12, 13 each. The rotating drums 12, 13 each receive a pair of articles, wherein reception is effected from the upper side of the tracks 23, 24. However, as, according to the offset of the separators 26, 27, the drums 12, 13 are also offset, that is, the point of removal of the tobacco sticks 28 from the drum 12 is before the point of removal of the tobacco sticks 28 from the drum 13 in place and time, the reception of the two pairs of articles takes place simultaneously. The two drums 12, 13 rotate with the received pairs of articles, namely, the altogether four tobacco sticks 28, through 90° and then simultaneously discharge the four tobacco sticks 28 to the respectively corresponding transfer drum 15 or 16. The transfer drums 15, 16 transport the pairs of articles transversely axially on the tracks 37, 38 to the next processing station, e.g. to the filter-attaching machine. For this purpose the transfer drums 15, 16 rotate in the same direction, so that the pairs of articles are carried away parallel adjacent to each other and in the same direction of transport 34 on the two tracks 37, 38.

The method with the apparatus according to FIG. 3 proceeds basically similarly. However, on account of the different arrangement of the transfer drums 15, 16, the drums 12, 13 rotate at different angles. After receiving the tobacco sticks 28 the drum 12 rotates through 90° and then passes the tobacco sticks 28 on to the transfer drum 15. The drum 13 rotates with the tobacco sticks 28 through 270° before it passes the tobacco sticks 28 on to the transfer drum 16. The transfer drums 15, 16 rotate in opposite directions for transport in the direction of transport 34, however.

With the apparatus 10 according to FIG. 4, the tobacco sticks 28 are received on different sides (upper side and lower side) of the longitudinal conveyor 25. The drum 12 removes the pair of articles from the lower side of the track 23, while the drum 13 removes the pair of articles from the upper side of the track 24. The counter-rotating drums 12, 13 both turn through an angle of 90° and then discharge the pairs of articles to the also counter-rotating transfer drums 15, 16 which then transversely axially convey the pairs of articles parallel in the direction of transport 34.

Figure 5:
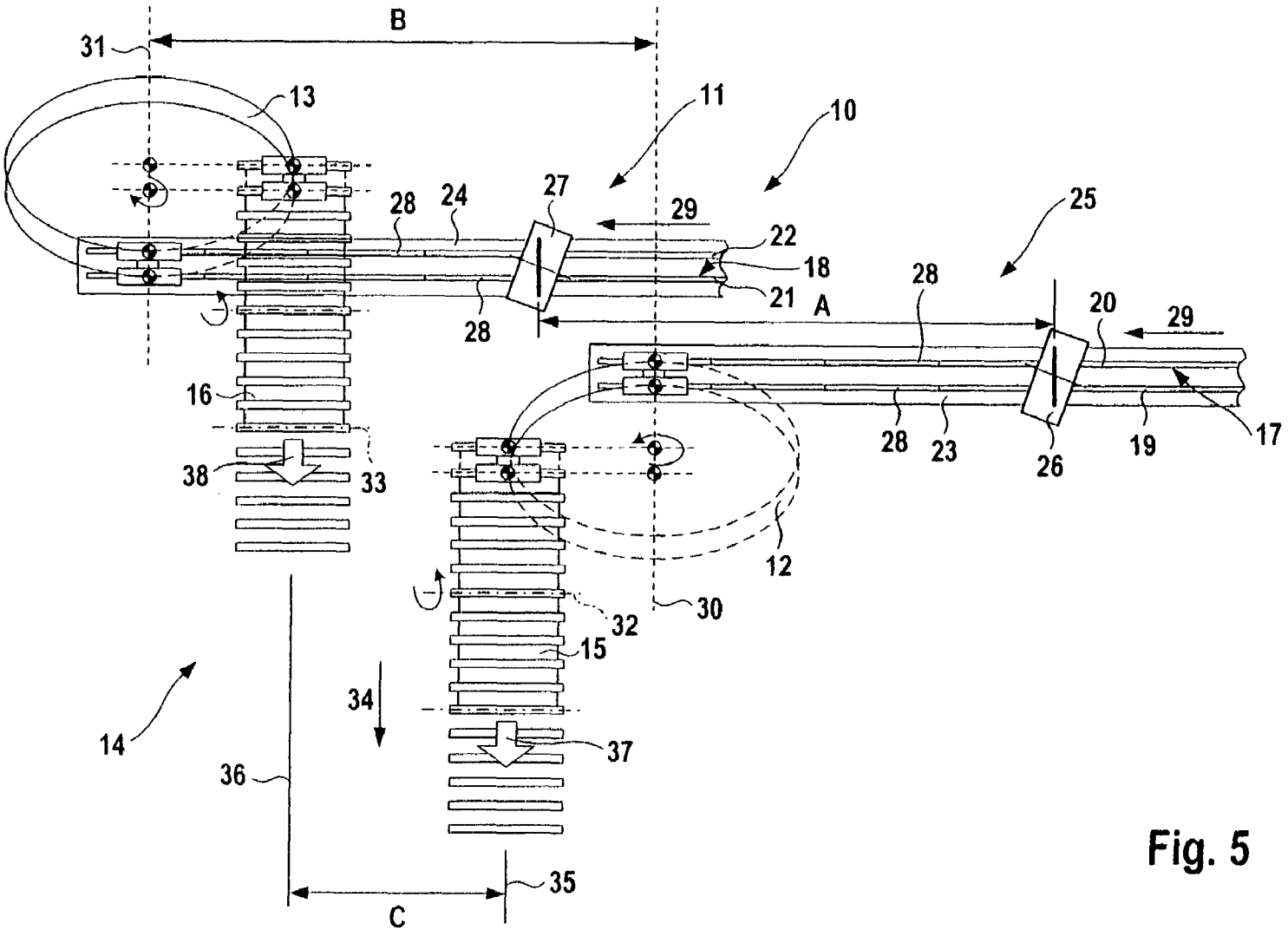
FIG. 5 shows a schematic view of a further embodiment of the apparatus.

The method with the apparatus 10 in FIG. 5 essentially corresponds to the method with the embodiment described in conjunction with FIG. 4. However, the drums 12, 13 rotate in opposite directions through different angles. The drum 12 rotates with the tobacco sticks 28 through 90°. The drum 13 rotates with the tobacco sticks 28 through 270°. After simultaneous discharge of the two pairs of articles onto the transfer drums 15, 16 driven in the same direction, the pairs of articles are conveyed in the transverse axial direction parallel to each other in the direction of transport 34.

Other configurations are possible by varying the position of the separators 26, 27, varying the position of the drums 12, 13, varying the transfer drums 15, 16 and arranging the tracks 23, 24 relative to each other. It is crucial that the conveyor 11 has two receiving points for at least two pairs of articles, and two discharge points for the same.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for the transfer of rod-shaped articles from a longitudinal conveyor that longitudinal axially conveys the articles onto a transverse conveyor that transverse axially conveys the articles transversely to their axes, a direction of transport of the longitudinal conveyor and the transverse conveyor being transverse to each other, the apparatus comprising:

a conveyor having receptacles structured to receive articles from the longitudinal conveyor and to discharge the received articles onto the transverse conveyor, the conveyor being structured and arranged to receive at least two pairs of articles, which are delivered to the conveyor on separate tracks of the longitudinal conveyor, and the conveyor being further structured and arranged to discharge the pairs of articles to two separate tracks of the transverse conveyor.

2. The apparatus according to claim 1 wherein the rod-shaped articles are cigarettes.

3. The apparatus according to claim 1 wherein the conveyor is structured and arranged to simultaneously receive and discharge a plurality of pairs of articles.

4. The apparatus according to claim 1 wherein the conveyor further comprises:

two separate drums which are each structured and arranged to receive one pair of articles from a respective separate track of the longitudinal conveyor and to discharge one pair of articles onto a respective separate track of the transverse conveyor.

5. The apparatus according to claim 4 wherein the two drums are arranged one behind the other in the direction of transport of the longitudinal conveyor.

6. The apparatus according to claim 4 wherein the drums are configured to be driven in one of opposite or the same direction.

7. The apparatus according to claim 4 wherein both drums are arranged above the longitudinal conveyor.

8. The apparatus according to claim 4 wherein one of the drums is arranged below and the other drum is arranged above one of the tracks.

9. The apparatus according to claim 1 wherein the longitudinal conveyor further comprises:

separators that separate the articles from double rods in pairs, the separators being positioned in a region of the separate tracks which run parallel to each other and each convey a continuous double rod.

10. The apparatus according to claim 4 wherein the transverse conveyor includes two separate transfer drums forming the separate tracks, wherein each transfer drum is associated with one of the two separate drums.

11. The apparatus according to claim 9, wherein the two transfer drums can be driven optionally in opposite or the same directions.

12. The apparatus according to claim 10, wherein a distance A between separators in the direction of transport of the longitudinal conveyor is equal to the distance B between two center axes of the drums in the direction of transport of the longitudinal conveyor and equal to the distance C between the two central axes of movement of the transfer drums transverse to the direction of transport of the transverse conveyor.

13. The apparatus according to claim 12, characterized in that the distances A and B are the same and the distance C is smaller than the distances A and B.

14. A method for the transfer of rod-shaped articles from a longitudinal conveyor that longitudinal axially conveys the articles to a transverse conveyor that transverse axially conveys the articles, a direction of transport of the longitudinal conveyor and transverse conveyor being transverse to each other, the method comprising:

receiving at least two pairs of rod-shaped articles from separate tracks of the longitudinal conveyor;

moving the at least two pairs of the articles through predetermined angles; and discharging the at least two pairs of articles onto separate tracks of transverse conveyor.

15. The method according to claim 14 wherein the rod-shaped articles are cigarettes.

16. The method according to claim 14, wherein a plurality of pairs of articles are received simultaneously from the separate tracks and discharged simultaneously onto the separate tracks.

17. The method according to claim 14, wherein a conveyor is structured and arranged to move the at least two pairs of articles through the predetermined angles.

18. The method according to claim 17 wherein the conveyor comprises at least two spider drums, such that each of the two pairs of articles are received by a respective separate drum of the conveyor and discharged to a respective separate transfer drum of the transverse conveyor.

19. A conveyor for transfer of rod-shaped articles for use in the method of claim 14.

20. An apparatus for the transfer of rod-shaped articles comprising:

a longitudinal conveyor composed of at least two separate tracks that longitudinal axially convey at least two pairs of the articles;

a transverse conveyor that conveys the at least two pairs of articles transversely to a direction of the longitudinal conveyor; and a conveyor having receptacles that receive the at least two pairs of articles from the separate tracks of the longitudinal conveyor and that discharge the received at least two pairs of the articles onto the separate tracks of the transverse conveyor.

21. The apparatus according to claim 20 wherein the separate tracks of the longitudinal conveyor are each structured and arranged to convey pairs of articles, and the separate tracks of the transverse conveyor are each structured and arranged to convey the pairs of articles.

22. The apparatus according to claim 20 wherein the rod-shaped articles are cigarettes.

23. The apparatus according to claim 20 wherein the conveyor is structured and arranged to simultaneously receive and discharge a plurality of pairs of articles.

24. The apparatus according to claim 20 wherein the conveyor further comprises:

two separate drums which are structured and arranged to receive one pair of articles each from the separate tracks of the longitudinal conveyor and structured and arranged to discharge one pair of articles each onto one of the two separate tracks of the transverse conveyor.

25. An apparatus for the transfer of rod-shaped articles from a longitudinal conveyor that longitudinal axially conveys the articles onto a transverse conveyor that transverse axially conveys the rod-shaped articles transversely to their axes, a direction of transport of the longitudinal conveyor and the transverse conveyor being transverse to each other, the apparatus comprising:

a conveyor having receptacles structured to receive rod-shaped articles from the longitudinal conveyor and to discharge the received rod-shaped articles onto the transverse conveyor, the conveyor being structured and arranged to receive at least two pairs of the rod-shaped articles simultaneously discharged from the longitudinal conveyor, and to discharge the pairs of rod-shaped articles onto two separate tracks of the transverse conveyor.

* * * * *